US007337836B1

(12) United States Patent
Persson

(10) Patent No.: US 7,337,836 B1
(45) Date of Patent: Mar. 4, 2008

(54) HEAT EXCHANGER WITH LEAKAGE VENT

(75) Inventor: Lars Persson, Abbekås (SE)

(73) Assignee: EP Technology AB, Malmo (SE)

( * ) Notice: Subject to any disclaimer, the term of this patent is extended or adjusted under 35 U.S.C. 154(b) by 0 days.

(21) Appl. No.: 09/380,080

(22) PCT Filed: Feb. 17, 1998

(86) PCT No.: PCT/SE98/00273

§ 371 (c)(1),
(2), (4) Date: Nov. 15, 1999

(87) PCT Pub. No.: WO98/37374

PCT Pub. Date: Aug. 27, 1998

(30) Foreign Application Priority Data

Feb. 25, 1997 (SE) ..... 9700657

(51) Int. Cl.
*F28F 3/00* (2006.01)
*F28F 11/00* (2006.01)

(52) U.S. Cl. ..... 165/167; 165/70

(58) Field of Classification Search ..... 165/70, 165/71, 166, 167
See application file for complete search history.

(56) References Cited

U.S. PATENT DOCUMENTS

| | | | | |
|---|---|---|---|---|
| 1,754,857 A | | 4/1930 | Harrison | |
| 2,193,405 A | | 3/1940 | Goodman | |
| 3,451,473 A | * | 6/1969 | Urie et al. | 165/70 X |
| 3,469,623 A | * | 9/1969 | Rawlings | 165/70 |
| 3,633,661 A | * | 1/1972 | Duncan et al. | 165/70 |
| 4,903,758 A | | 2/1990 | Cowan | |
| 5,193,612 A | * | 3/1993 | Stirnkorb | 165/70 X |
| 5,913,361 A | * | 6/1999 | Engström et al. | 165/70 |

FOREIGN PATENT DOCUMENTS

| | | | | |
|---|---|---|---|---|
| DE | 2713977 | * | 10/1878 | 165/70 |
| DE | 42 07 761 | | 9/1972 | |
| DE | 3903084 | * | 8/1990 | 165/70 |
| IT | 632930 | * | 2/1962 | 165/70 |
| JP | 63-180084 | | 7/1988 | |
| SE | 109204 | | 12/1943 | |
| SE | 9001261 | | 10/1971 | |
| WO | WO 96/41995 | | 12/1996 | |

OTHER PUBLICATIONS

Lilljeqvist, Jorg, "Heat Exchanger of a Plate Exchanger Type" [Varmevaxlare av plattvaxlartyp], translated by Schreiber Translations, Inc., PTO 2007-6209, United States Patent and Trademark Office, Washington, D.C., Aug. 2007.*

* cited by examiner

*Primary Examiner*—Ljiljana Ciric
(74) *Attorney, Agent, or Firm*—Oblon, Spivak, McClelland, Maier & Neustadt, P.C.

(57) ABSTRACT

A heat exchanger with a leakage vent. A fully brazed heat exchanger has an arrangement preventing the two media inside the heat exchanger from mixing in case of leakage. The heat exchanger includes plates having a pattern of grooves and inlet and outlet connections. The plates are placed in a pack and brazed together so as to form separate channels for two media between alternating pairs of plates. A separation zone is created around the connection so as so block off the medium that is not to reach the respective connection. The other medium can flow on by. A leakage vent to the exterior is provided in the separation zone so as to allow detection of any leakage.

20 Claims, 2 Drawing Sheets

HEAT EXCHANGER WITH LEAKAGE VENT

BACKGROUND OF THE INVENTION

1. Field of the Invention

The present invention relates to a heat exchanger with a leakage vent, and more particularly to a fully brazed heat exchanger having an arrangement preventing the two media inside the heat exchanger from mixing in case of leakage. The invention also allows quick detection of the leakage. A separation zone is provided at each connection to the heat exchanger. The separation zone comprises a blocked-off space with leakage vents, where any leakage can be detected.

2. Discussion of the Background

The fully brazed heat exchangers of today comprise of brazed packs of plates lacking any possibility of internal inspection. One problem existing in such heat exchangers is that a brazing at a connection may break inside the heat exchanger. An invisible leak is then created inside the heat exchanger, whereupon the media become mixed without this being detectable from outside the heat exchanger. This has meant that such heat exchangers have been used only reluctantly e.g. for the cooling of machinery where the oil lubricating the machine is cooled by heat exchange with water. Water mixing into the oil could cause catastrophic results for the machine, which could in the worst case seize up completely.

Another type of heat exchanger is the seal type heat exchanger, which is held together by screw joints, with seals between the heat exchanger plates. The above problem of internal leakage has in these heat exchangers been solved by means of the seal extending in such a manner as to create a separation zone at each connection, and to create a leakage vent in the seal at the edge of the heat exchanger, in the separation zones. This means that any leakage will be externally visible. However, the heat exchanger will also have a large number of holes at the sides, resulting in other practical problems. Furthermore, the seal type heat exchanger can only be used for lower pressures (up to 50 bar); whereas brazed heat exchangers can be used for considerably higher pressures (up to 300 bar). The heat exchanger seals will age and have to be replaced at regular intervals. Brazed heat exchangers on the other hand are practically maintenance-free and furthermore cheaper to produce than seal type heat exchangers. Thus, it would be highly desirable to be able to use fully brazed heat exchangers in more applications than has been previously possible.

The present invention solves the above problem of internal leakage in a fully brazed heat exchanger by providing a separation zone at the connections. In case of a brazed seam breaking, a leakage occurs into the separation zone. The separation zone has a leakage vent to the exterior surroundings, enabling quick detection of the leakage. However, no mixing of media occurs due to the leakage.

SUMMARY OF THE INVENTION

The present invention thus provides a heat exchanger comprising plates having a pattern of grooves and inlet and outlet connections. The plates are placed so as to form a pack and brazed together so as to form separate channels for two media between alternating pairs of plates.

According to the invention, a separation zone is created around the connections, so as to block off the medium that is not to reach the connection in question, whereas the other medium can flow on by. A leakage vent to the exterior is provided in the separation zone so as to allow detection of any leakage.

The invention is defined in claim 1. Preferred embodiments of the invention are detailed in the dependent claims.

BRIEF DESCRIPTION OF THE DRAWINGS

The invention will be described in further detail below, with reference to the accompanying drawings, of which.

DETAILED DESCRIPTION OF PREFERRED EMBODIMENTS

Figure 1:
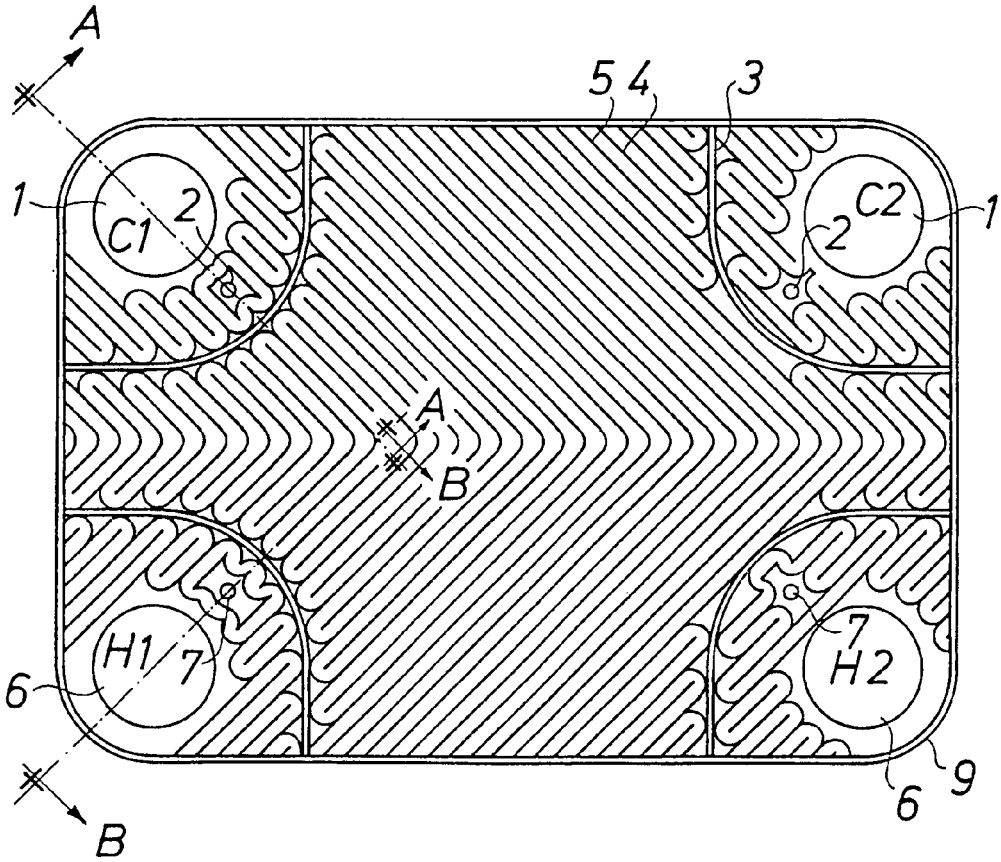
FIG. 1 is a top view of a plate for a heat exchanger according to the present invention.

FIG. 1 shows a plate for a heat exchanger according to the present invention. As is conventional, the plate has a groove pattern and connections. The grooves have peaks 4 and valleys 5. A cold medium has an inlet at C2 and an outlet at C1. A hot medium has an inlet at H2 and an outlet at H1. It is to be understood that the groove pattern may be varied in many different ways without deviating from the scope of the invention.

Figure 3:
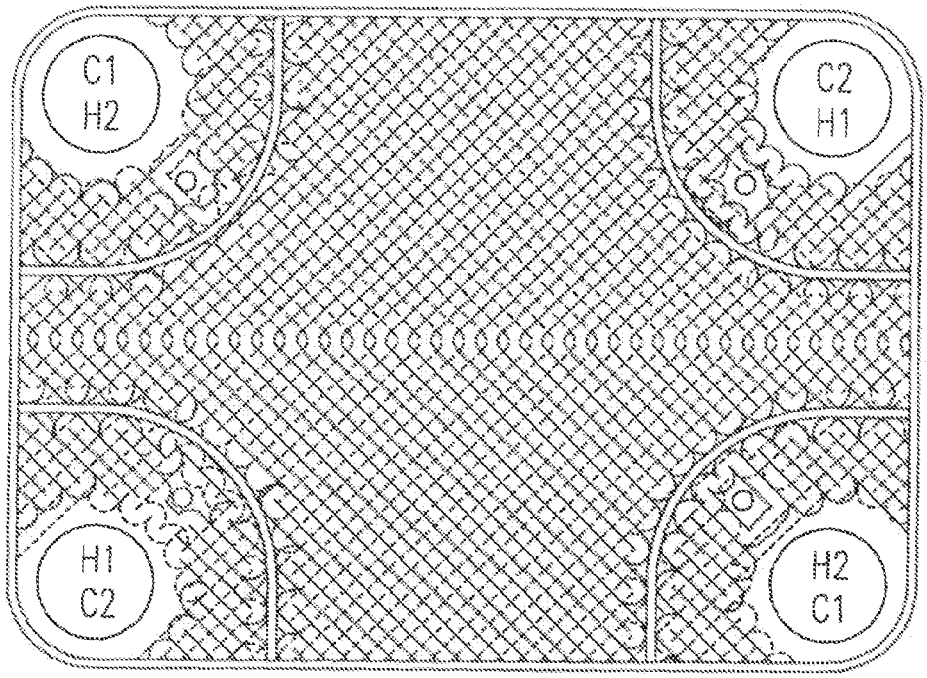
FIG. 3 is a top view of the plate of FIG. 1 together with another plate, the first plate being shown with broken lines to illustrate the orientation of two plates.

A heat exchanger is created by assembling a number of identical plates into a pack. Every other plate is turned 180° so as to create a crossing pattern and to form channels for the media between alternating pairs of plates, as is well known to those skilled in the art. FIG. 3 shows a lower plate visible through an upper plate in order to illustrate the crossing pattern. On one side of the pack there is also a bottom plate (not shown) for closing the connections on one side. The whole pack is brazed together in an oven so as to create brazing points where peaks cross each other. In a cross section, a honeycomb pattern is created. Furthermore, every other pair of plates is brazed together at the connections. This is explained in greater detail below, with reference to FIG. 4.

In a conventional heat exchanger, however, the groove pattern does not extend as shown in the drawings, but will run without interruption up to the brazing around the connections. It will be understood that if such a brazing breaks, the medium in the connection may penetrate into the wrong channel, i.e. a channel belonging to the other medium. This will cause the problem as described above.

The present invention has realized that the problem can be solved by means of an arrangement described hereinafter. Around each connection there is a separation zone created by a separation groove. The separation groove is preferably designed approximately like a quarter circle segment. Into the separation zone only that medium is allowed entry which flows in or out through the connection. Within the separation zone there is a blocked-off space, which cannot be reached by any one of the media. This space is provided with a leakage vent. The leakage vent is arranged in such a way that the medium flowing through the connection flows around the hole via the grooves. Thus, the medium does not "see" the hole. Nor can the other medium, flowing in the surrounding channels, reach the hole, due to the separation groove. The leakage vent can only be reached by medium if the brazing around the connection, or at the separation groove, breaks.

Figure 2A:
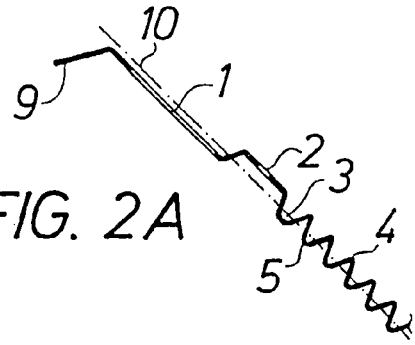
FIG. 2A is a sectional view along the line A-A of FIG. 1.
Figure 2B:
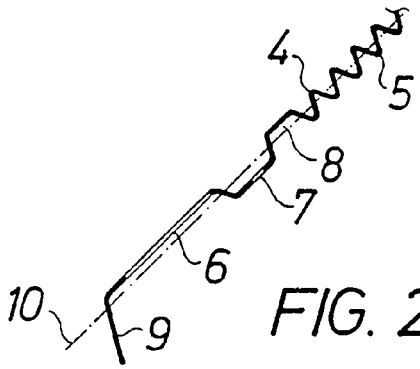
FIG. 2B is a sectional view along the line B-B of FIG. 1.

FIGS. 2A and 2B show the cross sections of two connections. FIG. 2A represents a connection that is lowered in relation to a reference plane 10, as shown at 1, whereas FIG. 2B illustrates a connection that is raised, as shown at 6. At the lowered connection 1, there is a lowered separation groove 3. At the raised connection there is a raised separation groove 8. At the lowered connection 1, there is a raised leakage vent 2. At the raised connection there is a lowered leakage vent 7. The leakage vents come from the blocked-off space 15 (FIG. 4).

Figure 4:
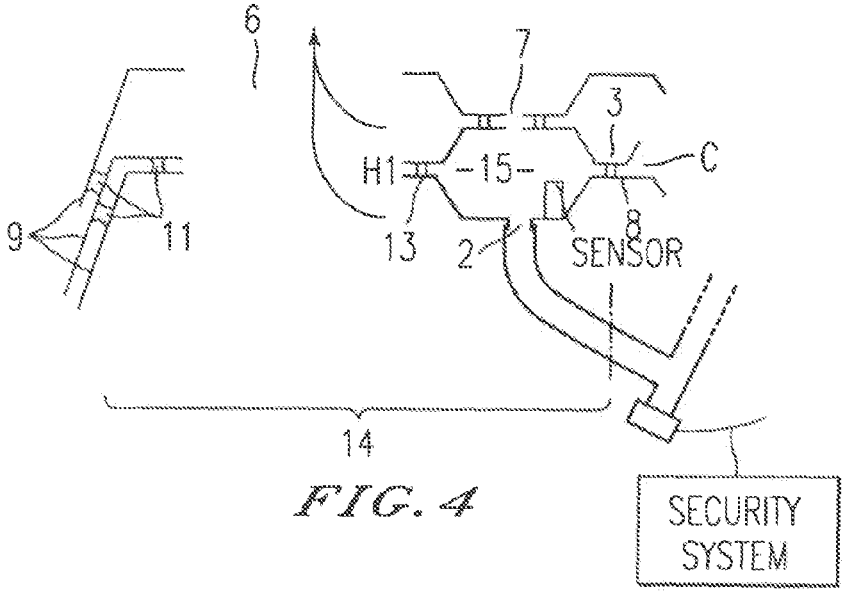
FIG. 4 is a partial cross section view through three plates according to the present invention.

FIG. 4 shows a cross section of three plates at a raised outlet connection, as shown at 6, where a medium H1 flows out. Brazings are shown as depicted at 11. The flowing out of the medium H1 is shown by arrows. The medium H1 arrives from channels created between alternating pairs of plates. The figure shows the two top ones of one pair and the top one of the next pair. The other medium is flowing in channels between the intermediate pairs, i.e. the two lower plates shown in FIG. 4, etc. The medium C does not reach the connection as it is blocked inside its channel at the separation grooves 3, 8. A separation zone 14 is thus created between the separation grooves 3, 8 and the brazing around the connection 6 and the edge 9 of the plates. The separation zone has a blocked-off space 15 that cannot be reached by the media H1, C. The blocked-off space is open to the atmosphere through the hole 2, 7 in each plate. These holes constitute the leakage vent. The leakage vent may optionally pass also through the bottom plate (not shown), but is suitably open only in one direction.

During normal operation, the medium H thus flows inside its channels past the leakage vent via the grooves, whereas the other medium C only reaches the separation zone. At the connections to the medium C, the reverse conditions of course prevail. If a brazing should break, either at 13, that is at the connection (or at the separation grooves 3, 8), the medium, in FIG. 4 the medium H (or C, respectively), will leak into the separation zone. Depending on the orientation of the heat exchanger, which may be arbitrary, the leaking medium will be collected in the separation zone and will subsequently be vented through the outermost of the holes 2, 7 to the exterior. Typically, such breaks occur at the connection, i.e. at 13 in FIG. 4. There is then no risk of the medium H penetrating into the wrong channel, to the other medium C, as was the case with the prior art, where the brazing at the connection was the only barrier between the media. Should the brazing break at the separation grooves 3, 8, there is also no risk of mixing the media.

When a leakage occurs, a little of the medium thus penetrates to the exterior of the heat exchanger. This may be detected by visual inspection of the heat exchanger. It is, however, preferable if this detection is performed automatically. According to a preferred embodiment of the invention, a sensor is connected to at least one separation zone; preferably to all four separation zones. The sensor may be located inside the separation zone in question or be connected via piping between the separation zone and the sensor. The different pipes from the separation zones may be connected to the same sensor.

The sensor or sensors may in turn be connected to some kind of security system. The security system may e.g. cause an alarm via audible signals or warning lights. For sensitive equipment, the security system can also provide for the machine to be stopped as soon as a leakage is detected.

It will be understood that the invention depicted in the drawings and the description may be varied in several ways. The number of leakage holes 2, 7 may be higher than one in each separation zone. It is to be understood that the holes must be located in rotational symmetry, as every other plate is turned 180°. In the drawings, the holes are shown located at n angle of 45°, centered between the edges of the plates, but it is possible to locate the holes closer to an edge. Arranging the holes closer to the edge may in certain cases make them more easily accessible. A person skilled in the art will furthermore understand that different types of sensors and their connections to the separation zones are possible. All such possibilities are considered to be within the scope of the invention.

The present invention thus provides a heat exchanger exhibiting several advantages compared to the previously known art. The invention allows for fully brazed heat exchangers, which are inexpensive in manufacture, may operate at higher pressures, and are practically maintenance-free, to be used within a much wider field of application, thanks to the risk of mixing the media in case of leakage and the catastrophic results involved, being eliminated. It is actually possible to continue operation in case of a minor leakage, as the risk of disaster is practically eliminated. Simultaneously, the invention provides a quick and automatic detection of leakage that may be used in security systems. The advantages of the invention are achieved at the cost only of the separation zone, which as such entails a somewhat reduced efficiency of the heat exchanger. This reduction may however be regarded as very minor, and is also present in the previously mentioned seal type heat exchangers.

Advantageous embodiments of the invention have been described in detail. As was stated above, the invention may be modified in various ways without departing from the scope thereof, as defined by the accompanying claims.

The invention claimed is:

1. A heat exchanger comprising:

plates having a pattern of grooves, and inlet and outlet connections, placed so as to form a pack and brazed together so as to form separate channels for two media between alternating pairs of plates;

a separation zone having a blocked-off space formed by a barrier of valleys and peaks in contact with each other in alternate pairs of plates at a distance from the connections, a brazing at the edges of the plates and a brazing at the connections, which blocked-off space cannot be reached by any one of the media except during leakage, in such a way that the medium which is not to reach and flow through the respective connection is blocked at the barrier between one pair of plates, whereas the other medium can flow through the separation zone in adjacent channels in surrounding pairs of plates and through the respective connection; and a leakage vent extending from the blocked-off space to the exterior.

2. A heat exchanger according to claim 1, wherein the blocked-off space is formed by a separation groove, running a distance from each connection and separating the connection towards the respective corner.

3. A heat exchanger according to claim 2, wherein the leakage vent includes holes, arranged in rotational symmetry, through the plates, such that the holes register when turning every other plate 180°.

4. A heat exchanger according to claim 2, further comprising a sensor for detecting leakage being located in one or more blocked-off spaces.

5. A heat exchanger according to claim 2, further comprising a pipe running from one or more closed-off spaces, said pipe being connected to a sensor for detecting leakage.

6. A heat exchanger according to claim 1, wherein the leakage vent includes holes, arranged in rotational symmetry through the plates, such that the holes register when turning every other plate 180°.

7. A heat exchanger according to claim 6, further comprising a sensor for detecting leakage being located in one or more blocked-off spaces.

8. A heat exchanger according to claim 6, further comprising a pipe running from one or more closed-off spaces, said pipe being connected to a sensor for detecting leakage.

9. A heat exchanger according to claim 6, wherein the holes are located at an angle of 45°, centered between the edges of the plates.

10. A heat exchanger according to claim 9, further comprising a sensor for detecting leakage being located in one or more blocked-off spaces.

11. A heat exchanger according to claim 9, further comprising a pipe running from one or more closed-off spaces, said pipe being connected to a sensor for detecting leakage.

12. A heat exchanger according to claim 6, wherein the holes are located close to one edge of the plates.

13. A heat exchanger according to claim 12, further comprising a sensor for detecting leakage being located in one or more blocked-off spaces.

14. A heat exchanger according to claim 12, further comprising a pipe running from one or more closed-off spaces, said pipe being connected to a sensor for detecting leakage.

15. A heat exchanger according to claim 1, further comprising a sensor for detecting leakage located in one or more blocked-off spaces.

16. A heat exchanger according to claim 15, wherein said sensor is connected to a security system.

17. A heat exchanger according to claim 15, further comprising a pipe running from one or more closed-off spaces, said pipe being connected to a sensor for detecting leakage.

18. A heat exchanger according to claim 1, further comprising a pipe running from one or more closed-off spaces, said pipe being connected to a sensor for detecting leakage.

19. A heat exchanger according to claim 18, further comprising plural pipes connected to a common sensor.

20. A heat exchanger according to claim 18, wherein said sensor is connected to a security system.

* * * * *